US007546885B2

(12) United States Patent
Longfield

(10) Patent No.: US 7,546,885 B2
(45) Date of Patent: Jun. 16, 2009

(54) APPARATUS AND METHOD FOR OBTAINING DOWNHOLE SAMPLES

(75) Inventor: Colin Longfield, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 332 days.

(21) Appl. No.: 11/380,031

(22) Filed: Apr. 25, 2006

(65) Prior Publication Data

US 2006/0260805 A1 Nov. 23, 2006

Related U.S. Application Data

(60) Provisional application No. 60/682,498, filed on May 19, 2005.

(51) Int. Cl.
*E21B 49/08* (2006.01)

(52) U.S. Cl. ..... 175/50; 166/264; 175/58

(58) Field of Classification Search ..... 175/50, 175/58; 166/264; 73/152.23, 152.24
See application file for complete search history.

(56) References Cited

U.S. PATENT DOCUMENTS 2,528,981 A * 11/1950 Stokes ..... 166/107
2,813,587 A * 11/1957 Mounce ..... 175/237
3,111,169 A 11/1963 Hyde
3,139,147 A * 6/1964 Hays et al. ..... 175/233
3,291,219 A 12/1966 Nutter
3,327,781 A 6/1967 Nutter
3,441,095 A * 4/1969 Youmans ..... 175/59
3,850,240 A * 11/1974 Conover ..... 166/162
3,859,851 A 1/1975 Urbanosky
4,507,957 A 4/1985 Montgomery et al.
4,860,581 A 8/1989 Zimmerman et al.
4,936,139 A 6/1990 Zimmerman et al.
5,230,244 A * 7/1993 Gilbert ..... 73/152.17
5,269,180 A * 12/1993 Dave et al. ..... 73/152.06
5,303,775 A 4/1994 Michaels et al.
5,337,838 A * 8/1994 Sorensen ..... 175/59
5,353,872 A 10/1994 Wittrisch
5,377,755 A 1/1995 Michaels et al.
5,555,945 A 9/1996 Schultz et al.
5,799,733 A * 9/1998 Ringgenberg et al. ..... 166/264
5,803,186 A 9/1998 Berger et al.
5,864,057 A 1/1999 Baird
6,029,744 A * 2/2000 Baird ..... 166/264
6,047,239 A 4/2000 Berger et al.
6,157,893 A 12/2000 Berger et al.
6,236,620 B1 * 5/2001 Schultz et al. ..... 367/82
6,272,434 B1 8/2001 Wisler et al.

(Continued)

FOREIGN PATENT DOCUMENTS

WO WO 01/63093 8/2001

*Primary Examiner*—Hoang Dang
(74) *Attorney, Agent, or Firm*—Dave R. Hofman; Darla P. Fonseca; Brigitte L. Echols

(57) ABSTRACT

A downhole drilling tool positionable in a wellbore penetrating a subterranean formation is provided. The tool includes a formation evaluation tool having fixed and retrievable portions. The fixed portion is operatively connected to a drill collar of the downhole tool. The fixed portion is for establishing fluid communication with a subterranean formation. The retrievable portion is fluidly connected to the fixed portion and retrievable therefrom to a surface location. The retrievable portion is for receiving a formation fluid from the subterranean formation.

21 Claims, 3 Drawing Sheets

U.S. PATENT DOCUMENTS

| | | | | |
|---|---|---|---|---|
| 6,343,650 | B1 * | 2/2002 | Ringgenberg | 166/250.17 |
| 6,435,279 | B1 | 8/2002 | Howe et al. | |
| 6,439,307 | B1 | 8/2002 | Reinhardt | |
| 6,467,544 | B1 | 10/2002 | Brown et al. | |
| 6,557,632 | B2 | 5/2003 | Cernosek | |
| 6,577,244 | B1 | 6/2003 | Clark et al. | |
| 6,668,924 | B2 | 12/2003 | Bolze et al. | |
| 6,688,390 | B2 | 2/2004 | Bolze et al. | |
| 6,729,398 | B2 | 5/2004 | Ringgenberg et al. | |
| 6,745,835 | B2 | 6/2004 | Fields | |
| 6,877,332 | B2 | 4/2005 | DiFoggio | |
| 2003/0033866 | A1 | 2/2003 | Diakonov et al. | |
| 2003/0066646 | A1 | 4/2003 | Shammai et al. | |
| 2004/0055400 | A1 | 3/2004 | Ringgenberg et al. | |
| 2004/0089448 | A1 | 5/2004 | DiFoggio | |
| 2004/0106524 | A1 | 6/2004 | Jones et al. | |
| 2004/0216521 | A1 | 11/2004 | Shammai et al. | |
| 2004/0244971 | A1 | 12/2004 | Shammai et al. | |
| 2005/0011644 | A1 | 1/2005 | Krueger et al. | |
| 2005/0028974 | A1 | 2/2005 | Moody | |

* cited by examiner

APPARATUS AND METHOD FOR OBTAINING DOWNHOLE SAMPLES

CROSS-REFERENCE TO RELATED APPLICATIONS

This application claims priority to U.S. Provisional Application No. 60/682,498, entitled "APPARATUS AND METHOD FOR OBTAINING DOWNHOLE SAMPLES" filed on May 19, 2005, which is hereby incorporated in its entirety.

BACKGROUND

The present invention relates to sampling downhole fluids in a wellbore penetrating a subterranean formation. In particular, this invention relates to techniques for collecting downhole fluid samples and retrieving the samples to a surface location.

Wellbores, which are also known as boreholes, are drilled for hydrocarbon prospecting and production. It is often desirable to perform various evaluations of the formations penetrated by a wellbore during drilling operations, such as during periods when actual drilling has temporarily stopped. In some cases, the drill string may be provided with one or more drilling tools to test and/or sample the surrounding formation. In other cases, the drill string may be removed from the wellbore, in a sequence called a "trip," and a wireline tool may be deployed into the wellbore to test and/or sample the formation. The samples or tests performed by such downhole tools may be used, for example, to locate valuable hydrocarbon-producing formations and manage the production of hydrocarbons therefrom.

Such drilling tools and wireline tools, as well as other wellbore tools conveyed on coiled tubing, drill pipe, casing or other conveyors, are also referred to herein simply as "downhole tools." Such downhole tools may themselves include a plurality of integrated modules, each for performing a separate function, and a downhole tool may be employed alone or in combination with other downhole tools in a downhole tool string.

More particularly, formation evaluation often requires that fluid from the formation be drawn into a downhole tool, or module thereof, for testing in situ and/or sampling. Various devices, such as probes and/or packers, are extended from the downhole tool to isolate a region of the wellbore wall, and thereby establish fluid communication with the formation surrounding the wellbore. Fluid may then be drawn into the downhole tool using the probe and/or packers.

A typical probe employs a body that is extendable from the downhole tool and carries a packer at an outer end thereof for positioning against a sidewall of the wellbore. Such packers are typically configured with one relatively large element that can be deformed easily to contact the uneven wellbore wall (in the case of open hole evaluation), yet retain strength and sufficient integrity to withstand the anticipated differential pressures. These packers may be set in open holes or cased holes. They may be run into the wellbore on various downhole tools.

Another device used to form a seal with the wellbore sidewall is referred to as a dual packer. With a dual packer, two elastomeric rings are radially expanded about a downhole tool to isolate a portion of the wellbore wall therebetween. The rings from a seal with the wellbore wall and permit fluid to be drawn into the downhole tool via the isolated portion of the wellbore.

The mudcake lining the wellbore is often useful in assisting the probe and/or dual packers in making the appropriate seal with the wellbore wall. Once the seal is made, fluid from the formation is drawn into the downhole tool through an inlet therein by lowering the pressure in the downhole tool. Examples of probes and/or packers used in various downhole tools are described in U.S. Pat. Nos. 6,301,959, 4,860,581, 4,936,139, 6,585,045, 6,609,568, and 6,719,049, and U.S. Patent Application Publication No. 2004/0000433, which are incorporated herein by reference.

Fluid is drawn into the down tool through an inlet in the probes or packers. Fluid flows into a flowline and is selectively delivered to a sample chamber or bottle for collection therein. Examples of sample chambers and related techniques used in downhole tools are depicted in U.S. Pat. Nos. 6,745,835, 6,688,390, 6,659,177, 5,803,186, 5,233,866, 5,303,775, and 5,377,755, among others. Sample chambers are containers typically provided with an internal piston that retains the collected fluid under pressure. Once fluid is collected in the sample chamber, the tool is retrieved to the surface, and the sample chambers are removed for further analysis. In some cases, the sample chambers are removed at the surface for evaluation. In other cases, the sample chambers are taken to an offsite facility for further testing.

Despite the advances in sampling technology, there remains a need to obtain samples without interrupting the downhole operations being performed by the downhole tool. In some instances, sample chambers may become defective, full or other wise inoperable during operations. These remains a need for techniques for obtaining samples more quickly and/or without having to remove the tool. In such cases, it is desirable to retrieve one or more sample chambers from the downhole tool without withdrawing the tool.

Techniques have been developed for retrieving, measurement and logging while drilling tools (MWD, LWD) from downhole drilling tools. These MWD and LWD tools are typically deployed into and retrieved from downhole drilling tools via wireline or slickline devices. In such cases, the component is sent downhole through a mud channel extending through the downhole drilling tool and operatively inserted into the bottom hole assembly of the downhole drilling tool. Examples of such devices and related techniques are described in U.S. Pat. No. 6,577,244. However, no known techniques exist for retrieving sample chambers from downhole devices or tools. Difficulty exists in maintaining samples under the desired pressure, and preventing contamination of the sample during extraction and/or transport.

A need therefore exists for a system and method capable of collecting a sample and transporting it to the surface without requiring the removal of the downhole tool. It is desirable that such a system be operable even under harsh drilling environments, such as offset drilling conditions. It is further desirable that such a system be capable of isolating the sample from contamination and/or damage during transportation to the surface. These and other features of the invention are set forth herein.

SUMMARY OF THE INVENTION

In an aspect, the invention relates to a downhole drilling tool positionable in a wellbore penetrating a subterranean formation. The tool includes a formation evaluation tool having fixed and retrievable portions. The fixed portion is operatively connected to a drill collar of the downhole tool. The fixed portion is for establishing fluid communication with a subterranean formation. The retrievable portion is fluidly connected to the fixed portion and retrievable therefrom to a surface location. The retrievable portion is for receiving a formation fluid from the subterranean formation.

In another aspect, the invention relates to a formation evaluation while drilling tool positionable in a wellbore penetrating a subterranean formation. The tool includes a fluid communication device extendable from the drilling tool for establishing fluid communication with the subterranean formation. The fluid communication device has an inlet for receiving formation fluid from the subterranean formation and at least one sample chamber for receiving the formation fluid. The sample chambers are operatively connected to the fluid communication device via at least one flowline. The sample chambers are also positioned in the drill collar and retrievable therefrom to the surface.

In yet another aspect, the invention relates to A method of performing formation evaluation via a downhole drilling tool positionable in a wellbore penetrating a subterranean formation. The method involves establishing fluid communication between a fixed portion of the downhole drilling tool and the formation, drawing a formation fluid from the formation and into the fixed portion, passing the formation fluid from the fixed portion to a retrievable portion of the downhole drilling tool and retrieving the retrievable portion of the downhole drilling tool to a surface location.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
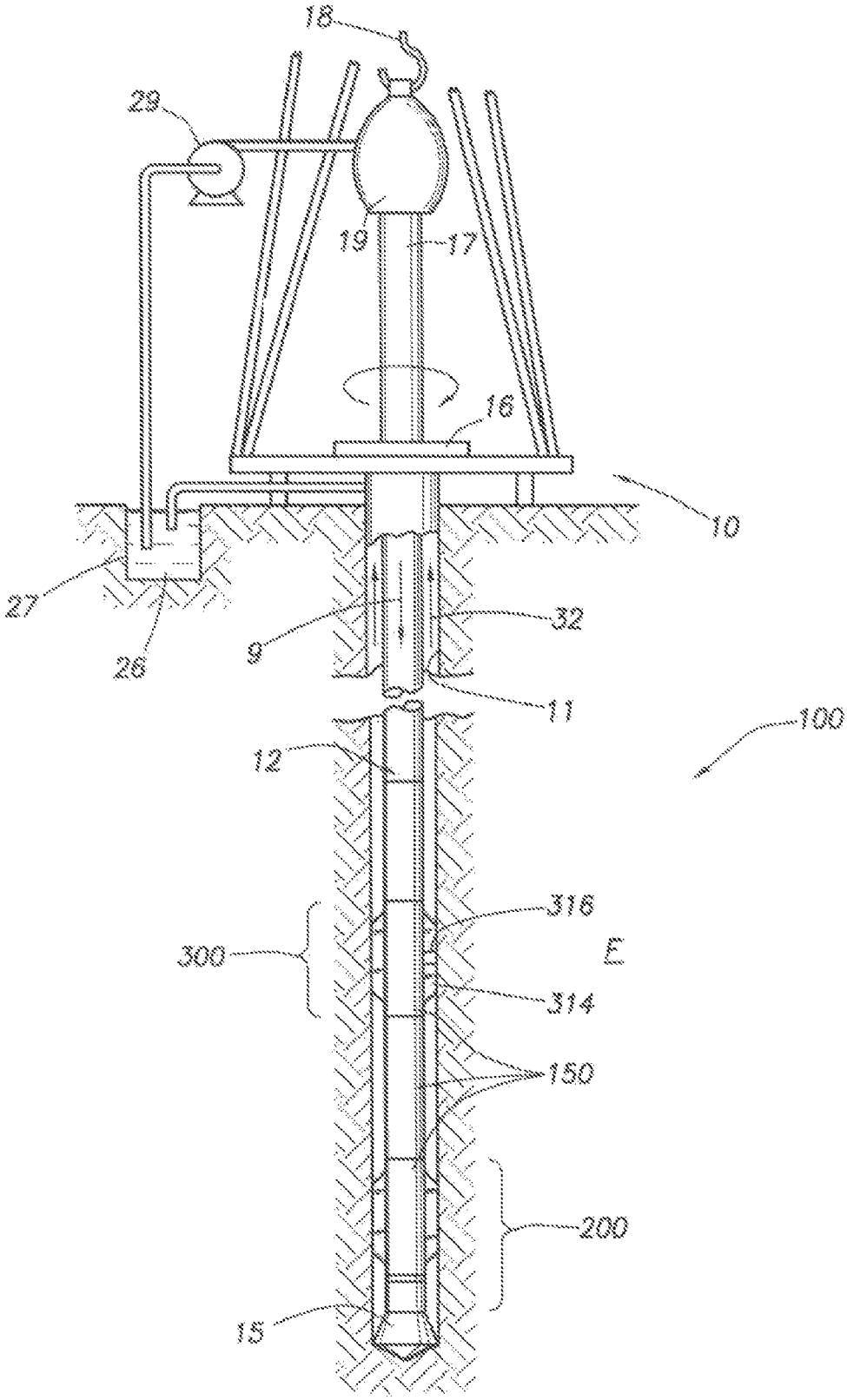
FIG. 1 is a schematic view, partially in cross-section of drilling rig with a downhole drilling tool advanced into a wellbore via a drill string, the downhole drilling tool includes a formation evaluation assembly therein.

Referring now to FIG. 1, a conventional drilling rig and drill string are shown wherein a land-based platform and derrick assembly 10 is positioned over a wellbore 11 penetrating subsurface formation F. In the illustrated embodiment, the wellbore 11 is formed by rotary drilling in a manner that is well known. Those of ordinary skill in the art given the benefit of this disclosure will appreciate, however, that the present invention also finds application in directional drilling applications as well as rotary drilling, and is not limited to land-based rigs.

A drill string 12 is suspended within the wellbore 11 and includes a drill bit 15 at its lower end. The drill string 12 is rotated by a rotary table 16, energized by means not shown, which engages a kelly 17 at the upper end of the drill string 12. The drill string 12 is suspended from a hook 18, attached to a traveling block (also not shown), through the kelly 17 and a rotary swivel 19, which permits rotation of the drill string 12 relative to the hook 18.

Drilling fluid or mud 26 is stored in a pit 27 formed at the well site. A pump 29 delivers drilling fluid 26 to the interior of the drill string 12 via a port in the swivel 19, inducing the drilling fluid 26 to flow downwardly through the drill string 12 as indicated by directional arrow 9. The drilling fluid 26 exits the drill string 12 via ports in a drill bit 15, and then circulates upwardly through the region between the outside of the drill string 12 and the wall of the wellbore 11, called the annulus, as indicated by direction arrows 32. In this manner, the drilling fluid lubricates the drill bit 15 and carries formation cuttings up to the surface as it is returned to the pit 27 for recirculation.

The drill string 12 further includes a downhole tool or bottom hole assembly (BHA), generally referred to as 100, near the drill bit 15. The BHA 100 includes drill collars 150 housing various components capable of measuring, processing, and storing information, as well as communicating with the surface. One such component is a measuring and local communications apparatus 200 for determining and communicating the resistivity of formation F surrounding the wellbore 11. Another component is a formation evaluation assembly 300. The formation evaluation assembly 300 includes stabilizers or ribs 314, and a probe 316 positioned in a stabilizer.

Figure 2A:
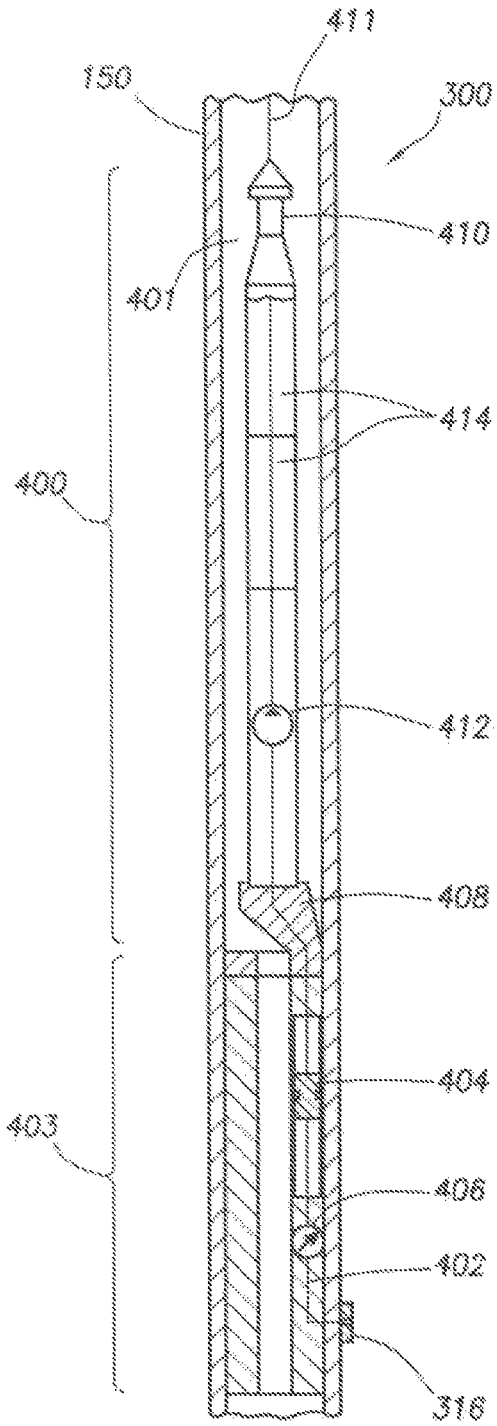
FIG. 2A is a schematic view of the formation evaluation assembly of FIG. 1 including a retrievable sampling tool.

Referring now to FIG. 2A, the formation evaluation assembly 300 is positioned in a drill collar 150. The formation evaluation assembly 300 includes a fixed section or portion 403 and a retrievable section or portion 400. The drill collar 150 has an annulus 401 extending therethrough for the passage of mud or drilling fluid. As shown, the fixed portion 403 is positioned in the drill collar 150 with a passage defined and extending therethrough. The retrievable portion 400 is positioned centrally within the annulus 401. However, it will be appreciated that the tools may be positioned and/or supported within the drill collar in a manner that facilitates formation evaluation and/or mud flow operations. The portions may be in one or more drill collars. The portions may be adjacent, or extended a distance across the downhole tool.

The probe 316 is positioned in the fixed portion 403 and extends therefrom to contact the wall of the wellbore 11 and establish fluid communication with an adjacent formation. The fixed portion 403 includes a pretest piston 404 and pressure gauge 406. Other devices, such as sensors, fluid analysis, hydraulics, electronics, etc., may also be provided.

The retrievable portion 400 has a latching mechanism 408 as a downhole end thereof, and a fishing/wireline head 410 at an uphole end thereof. The latching mechanism 408 removably connects the retrievable sampling tool (or the retrievable portion 400) to the drill collar 150. The fishing head 410 is preferably adapted for connection to a wireline 411. Alternatively, a slickline or other retrieval mechanism may be used to facilitate retrieval to the surface. The retrievable portion 400 may also be deployed into the downhole tool or formation evaluation assembly 300 using a tractor, mud flow, gravity or other conveyance. The retrievable portion 400 is then secured in place using the latching mechanism 408.

The wireline 411 may be used to provide power to the retrievable and/or fixed portions, as well as other portions of the downhole tool. In such cases, the downhole tool may be operated using power from the wireline 411 to supplement or replace power from mud flow. The downhole tool is thereby enable to operate in an LWD mode, or in wireline mode. In LWD mode, the downhole tool receives power from the flow of mud through a downhole generator (not shown). In wireline mode, the wireline 411 electrically conveys power to the downhole tool. The wireline mode permits operation when mud cannot be passed through the downhole tool, for example when the tool is 'tripping.'

The latching mechanism 408 is adapted to make fluid connection of a flowline 402 between the retrievable portion 400 and the fixed portion 403. The latching mechanism 408 includes a self-sealing mechanism (not shown) to seal the fixed portion 403 and prevent fluid flow therein when the retrievable portion 400 is detached. This self-sealing mechanism is preferably robust enough to withstand the high mud flow-rate in the mud channel following removal of the retrievable portion 400.

The retrievable portion 400 includes a pump 412 and sample chambers or bottles 414. One or more sample bottles of a desired size may be used. Preferably the sample chambers are slim to allow for passage of mud. Sample bottles longer than a drill collar may be used and extend through the retrievable portion 400. The flowline 402 extends through the fixed portion 403 and the retrievable portion 400. The flowline 402 fluidly connects the probe 316 to the sample chambers 414 in the retrievable portion 400. Additional valving, sample chambers, pumps, exit ports, charging chambers and other devices may be provided in the sampling assembly to facilitate the formation evaluation process. While the pump 412 is depicted in the sampling tool or retrievable portion 400, and the pretest and gauge are depicted as being in the drill collar portion or fixed portion 403 of the formation evaluation tool, these devices may be positioned in various locations about the formation evaluation tool.

Figure 2B:
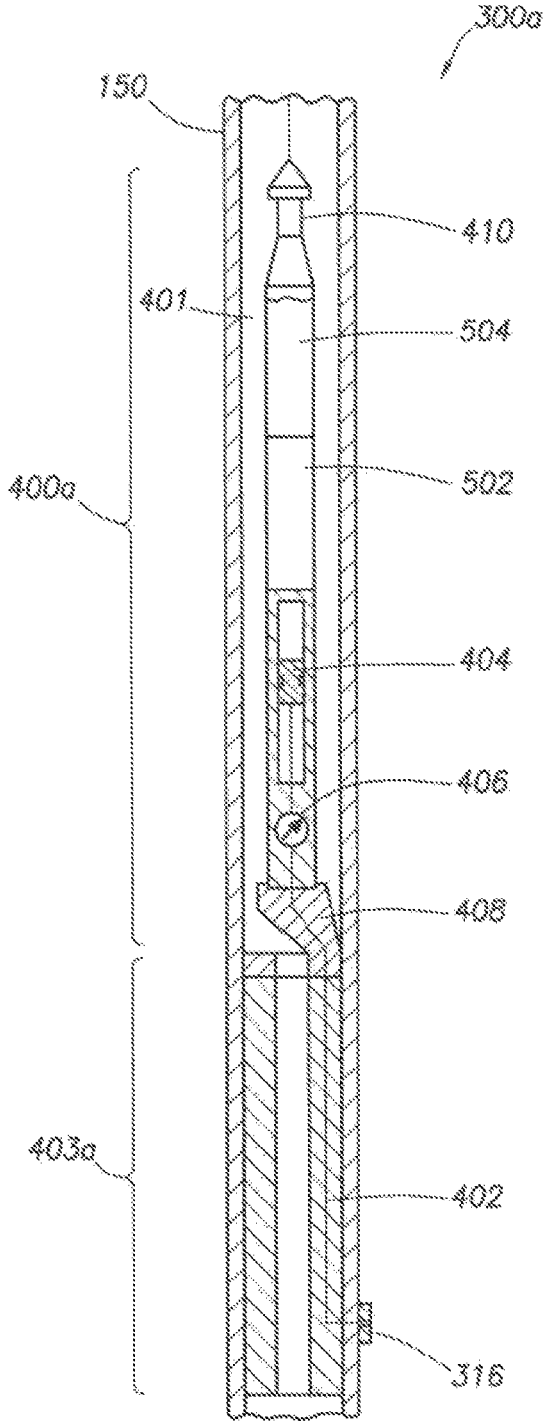
FIG. 2B is a schematic view of an alternate formation evaluation assembly including an alternate retrievable sampling tool.

Referring now to FIG. 2B, an alternate formation evaluation assembly 300*a* is depicted. The formation evaluation assembly 300*a* is similar to the formation evaluation assembly 300 of FIG. 2A, except that the fixed portion 403*a* contains the probe 316, and the retrievable portion 400*a* contains the pretest piston 404, pressure gauge 406, electronics 502 and hydraulics 504. With this configuration, additional components are positioned in the retrievable portion 400*a* and may be retrieved to the surface for replacement or adjustment as necessary.

As depicted in FIG. 2B, the formation evaluation tool 300*a* has no sample chambers or pumps. The configuration of FIG. 2B may be used for performing formation testing without sampling. However, these and other components may optionally be provided to enable sampling operations.

Figure 2C:
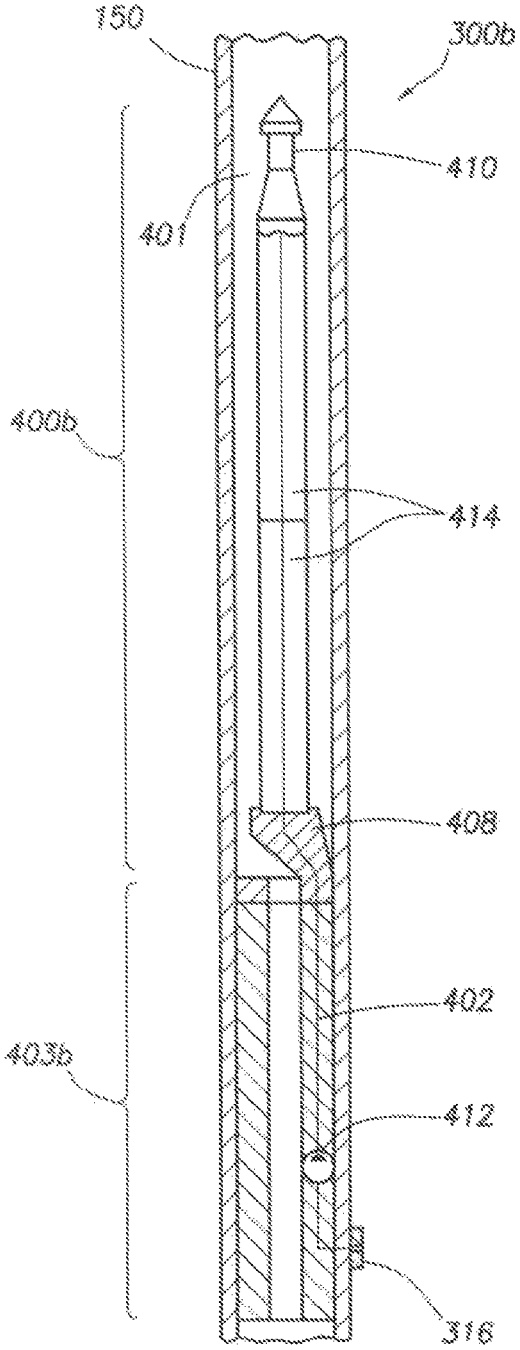
FIG. 2C is a schematic view of an alternate formation evaluation assembly including a retrievable sample chamber.

Referring now to FIG. 2C, another alternate formation evaluation assembly 300*b* is shown having a retrievable portion 400*b* and a fixed portion 403*b*. This configuration is similar to the formation evaluation assembly 300 of FIG. 2A, except that the pump 412 has been removed from retrievable portion 400*b* and positioned in the fixed portion 403*b*.

Figure 3A:
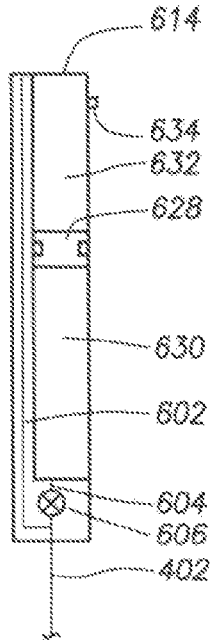
FIG. 3A is a schematic view of the retrievable sample chamber of FIG. 2C.
Figure 3B:
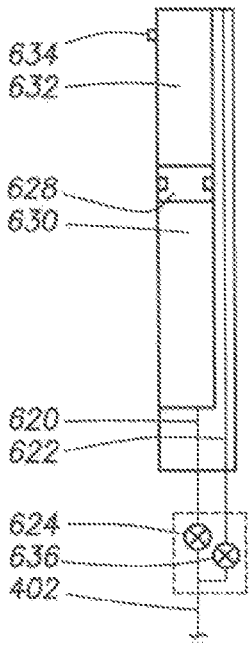
FIG. 3B is a schematic view of an alternate retrievable sample chamber.

FIGS. 3A and 3B depict flowline configurations for the downhole formation evaluation assembly. As shown in FIG. 3A, the flowline 402 branches into flowlines 602 and 604. A valve 606 selectively permits fluid flow from the flowline 402 into a sample chamber 614. When the valve 606 is closed, the flowline 402 may bypass the flowline 604 and the sample chamber 614 and proceed to other sample chambers or portions of the downhole tool. This enables a single flow line entering and exiting the bottle that will allow multiple bottles to be placed in series.

As shown in FIG. 3B, the flowline 402 branches to flowline 620 and 622. Valves 624 and 626 permit fluid to selectively pass into flowlines 620, 622, respectively. In this case, the valves are located remotely from the bottles, for example within the fixed portion or latch section. In this configuration, the valves 624 and 626 permit operation without the use of electrically operated valves in the bottles. Such a configuration obviates the need for wires. A separate flow 622 is provided for each sample chamber in series.

Referring now to FIGS. 3A and 3B, the sample chamber 614 includes a piston 628 slidably positioned therein. The piston defines a sample cavity 630 and a buffer cavity 632. The buffer cavity 632 has an exit port 634 in fluid communication with the wellbore. Other flowline configurations, valving and additional devices, such as nitrogen chambers, may also be used.

Preferably the pump 412, which is shown in FIG. 2C, is positioned adjacent the sample chambers to circulate formation fluid near the valves 624 and 626. The pump 412 may be positioned to minimize the amount of stagnant, contaminated fluid that will enter the sample chamber upon opening the valves.

It will be understood from the foregoing description that various modifications and changes may be made in the preferred and alternative embodiments of the present invention without departing from its true spirit. Furthermore, this description is intended for purposes of illustration only and should not be construed in a limiting sense. The scope of this invention should be determined only by the language of the claims that follow. The term "comprising" within the claims is intended to mean "including at least" such that the recited listing of elements in a claim are an open set or group. Similarly, the terms "containing," "having," and "including" are all intended to mean an open set or group of elements. "A," "an" and other singular terms are intended to include the plural forms thereof unless specifically excluded.

What is claimed is:

1. A downhole drilling tool positionable in a wellbore penetrating a subterranean formation, comprising:

a formation evaluation tool comprising:

a fixed portion operatively connected to a drill collar of the downhole tool, the fixed portion for establishing fluid communication with a subterranean formation; and a retrievable portion fluidly connected to the fixed portion and retrievable therefrom to a surface location, the retrievable portion for receiving a formation fluid from the subterranean formation, wherein the retrievable portion comprises a plurality of sample chambers for collecting a plurality of samples of the formation fluid.

2. The downhole drilling tool of claim 1, wherein the retrievable portion comprises a pump for inducing the flow of formation fluid therethrough.

3. The downhole drilling tool of claim 1, wherein the retrievable portion comprises at least one gauge for measuring properties of the formation fluid.

4. The downhole drilling tool of claim 1, wherein the retrievable portion comprises at least one pretest piston.

5. The downhole drilling tool of claim 1, wherein the fixed portion comprises a fluid communication device for sealing with the wellbore wall, the fluid communication device having at least one inlet for receiving the formation fluid.

6. The downhole drilling tool of claim 1, wherein the fixed portion comprises a pump for inducing the flow of formation fluid therethrough.

7. The downhole drilling tool of claim 1, wherein the fixed portion comprises at least one gauge for measuring properties of the formation fluid.

8. The downhole drilling tool of claim 1, wherein the fixed portion comprises at least one pretest piston.

9. The downhole drilling tool of claim 1 further comprising a fishing head positioned at an uphole end thereof

10. The downhole drilling tool of claim 1 further comprising a latching mechanism for operatively securing the retrievable portion to the fixed portion.

11. The downhole drilling tool of claim 1, further comprising a valve, wherein a first position of the valve permits fluid flow from the fixed portion into a first one of the plurality of sample chambers, and wherein a second position of the valve permits fluid flow from the fixed portion into a second one of the sample chambers.

12. The downhole drilling tool of claim 11, wherein the fixed portion comprises the valve.

13. The downhole drilling tool of claim 11, wherein the retrievable portion comprises the valve.

14. The downhole drilling tool of claim 1, further comprising a valve, wherein the fixed portion comprises a first flowline, wherein the retrievable portion comprises a second flowline and a third flowline, wherein a first position of the valve permits fluid flow from the first flowline into a first one of the plurality of sample chambers through the second flowline, and wherein a second position of the valve permits fluid flow from the first flowline into a second one of the sample chambers though the third flowline.

15. The downhole drilling tool of claim 1, further comprising a plurality of valves each configured to selectively permit fluid flow from a flowline of the fixed portion to a corresponding one of the plurality of sample chambers.

16. A method of performing formation evaluation via a downhole drilling tool positionable in a wellbore penetrating a subterranean formation, the method comprising:

establishing fluid communication between a fixed portion of the downhole drilling tool and a first portion of the formation;

drawing a first sample of formation fluid from the formation and into the fixed portion;

passing the first sample of formation fluid from the fixed portion to a first one of a plurality of sample chambers in a retrievable portion of the downhole drilling tool;

disestablishing fluid communication between the fixed portion of the downhole drilling tool and the first portion of the formation and establishing fluid communication between the fixed portion of the downhole drilling tool and a second portion of the formation;

drawing a second sample of formation fluid from the formation and into the fixed portion;

passing the second sample of formation fluid from the fixed portion to a second one of the plurality of sample chambers in the retrievable portion of the downhole drilling tool; and retrieving the retrievable portion of the downhole drilling tool to a surface location, thereby simultaneously retrieving to the surface location the first and second samples of formation fluid in the first and second ones of the plurality of sample chambers.

17. The method of claim 16, further comprising measuring at least one parameter of the formation fluid.

18. The method of claim 16, wherein the step of drawing the first sample of formation fluid comprises pumping the first sample of formation fluid from the formation and into the fixed portion, and wherein the step of drawing the second sample of formation fluid comprises pumping the second sample of formation fluid from the formation and into the fixed portion.

19. The method of claim 16, further comprising performing a pretest operation.

20. The method of claim 16, further comprising deploying the retrievable portion into the downhole drilling tool and securing it to the fixed portion.

21. The method of claim 16, wherein the step of retrieving comprises:

engaging a fishing head of the retrievable portion;

unlatching the retrievable portion from the fixed portion; and retrieving the retrievable portion to the surface.

* * * * *